United States Patent [19]

Sunde

[11] 4,382,646

[45] May 10, 1983

[54] METHOD FOR REMOVING GASES CAUSED BY OUT-GASSING IN A VACUUM VESSEL

[75] Inventor: Paul B. Sunde, Northridge, Calif.

[73] Assignee: Radcal Corporation, Monrovia, Calif.

[21] Appl. No.: 206,383

[22] Filed: Nov. 13, 1980

[51] Int. Cl.[3] ..... H01J 9/39

[52] U.S. Cl. ..... 445/41; 445/55

[58] Field of Search ..... 29/25.13, 25.15; 316/19, 24, 25

[56] References Cited

U.S. PATENT DOCUMENTS

| | | | |
|---|---|---|---|
| 2,445,993 | 7/1948 | Beggs | 29/25.15 X |
| 2,855,368 | 10/1958 | Perdijk et al. | 316/25 X |
| 3,408,130 | 10/1968 | Fransen et al. | 316/25 |
| 4,005,920 | 2/1977 | Wimmer | 316/19 |
| 4,175,808 | 11/1979 | Pakswer et al. | 316/19 |

*Primary Examiner*—Kenneth J. Ramsey

*Attorney, Agent, or Firm*—Arthur V. Doble

[57] ABSTRACT

A method of incorporating a getter material within a vacuum vessel by placing the vacuum vessel, along with the getter material, inside a vacuum chamber and evacuating the vacuum chamber and vacuum vessel, then heating the getter material to activate the getter, thereafter allowing the activated getter material to cool, followed by placing the getter material within the vacuum vessel and sealing the vacuum vessel, thereby protecting any temperature-sensitive materials contained within the vacuum vessel from the effects of any high temperatures produced during the activation of the getter material.

6 Claims, 3 Drawing Figures

FIG. 1.
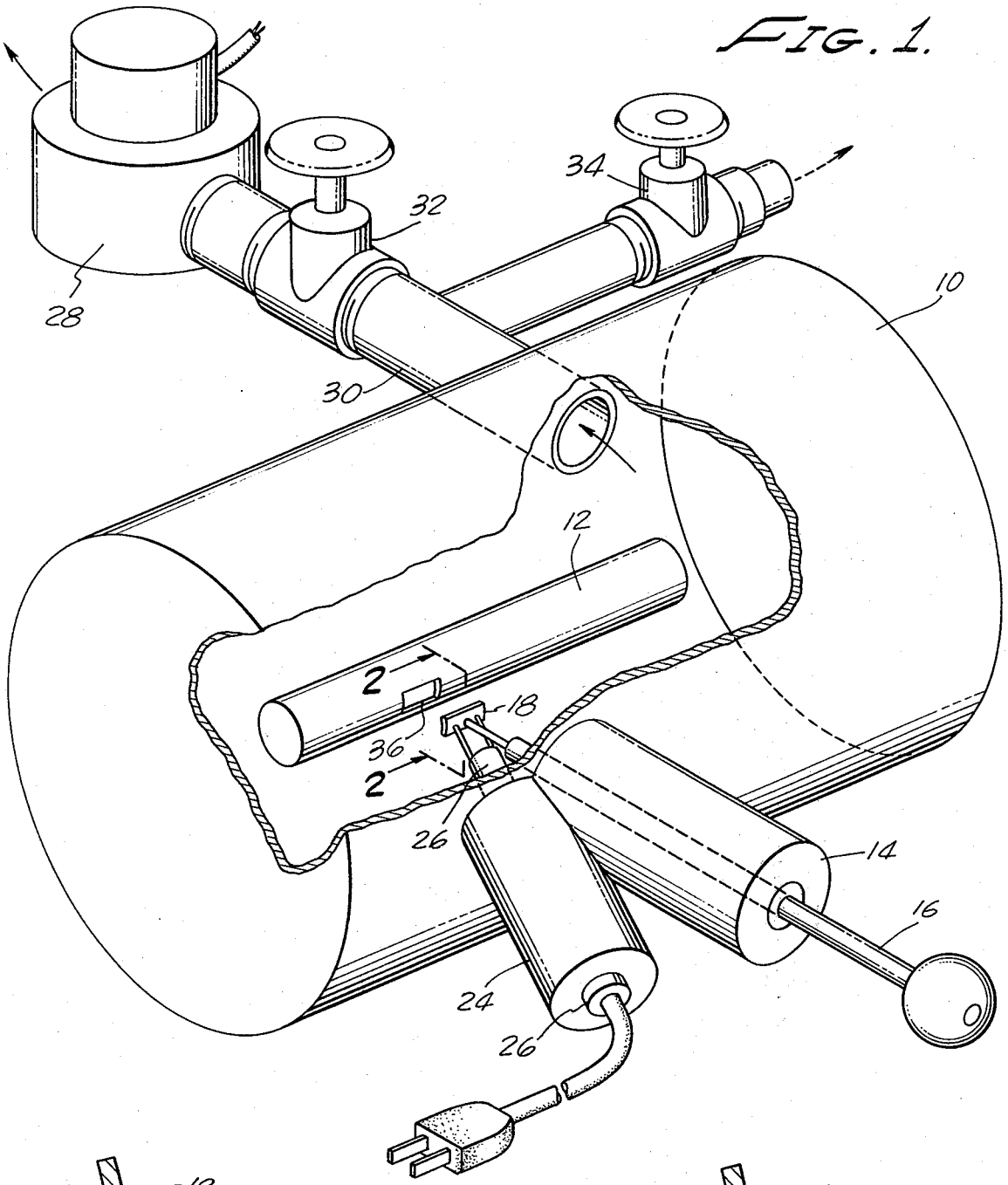
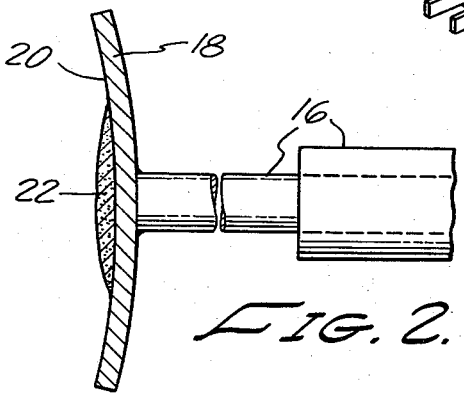
FIG. 2.
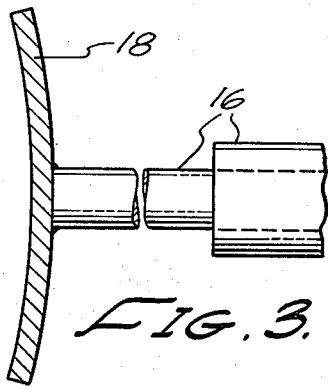
FIG. 3.

METHOD FOR REMOVING GASES CAUSED BY OUT-GASSING IN A VACUUM VESSEL

BACKGROUND OF THE INVENTION

1. Field of the Invention

The present invention relates to methods of alleviating out-gassing problems occurring in vacuum-sealed devices and more particularly to a method of removing gases caused by out-gassing in a vacuum vessel by utilizing an appropriate time-and-temperature profile to activate a getter for use in the vacuum vessel containing temperature-sensitive materials.

2. Description of the Prior Art

In some evacuated devices, e.g., vacuum vessels, it is necessary to incorporate therein materials which give off gas with the passage of time. This gas reduces the quality of the vacuum, thereby making the device unsuitable for its intended use. This phenomenon is commonly referred to as "out-gassing."

One method for removing this gas as it occurs is to incorporate a device which will pump the gases and eliminate them from the vacuum system. An ion pump is suitable for this purpose; however, it requires a magnetic field and a high voltage source adding to the size, weight, complexity, and the cost of the device.

Another method of removing the gas is to include a getter material inside the evacuated device. A getter is a substance introduced into an evacuated device to remove harmful residual gases by chemical or physical action. The "gettering" properties of certain materials have been recognized by scientists since the late 1800's, and as the applications became more obvious, the principle of the getter has been employed.

One method of employing getters consists of using getter materials which are evaporable. In many vacuum devices, it is not always possible to employ an evaporable getter due to the lack of a suitable surface on which to deposit the evaporated material. Additionally, evaporated getters can migrate onto sensitive surfaces thereby preventing the device from functioning properly. Another method employs getter materials which require activation prior to use by raising the getter to high temperature in a vacuum for a specified period of time. The activation temperature can damage sensitive components within the evacuated device and its application has heretofore been very limited in temperature-sensitive devices.

One particular area for the application of getter technology is in the field of evacuated radiation-detector devices such as the SEMIRAD quartz-fiber dosimeter. The SEMIRAD quartz-fiber dosimeter is a fountain pen-sized radiation detector which contains a tissue equivalent plastic chamber operating in a vacuum on the SEMIRAD (Secondary Electron MIxed RAdiation Dosimeter) principle. Primary electrons resulting from gamma radiation and recoil protons resulting from neutron radiation cause low energy secondary electrons to be emitted from the walls of the plastic chamber. These secondary electrons are collected, causing the quartz-fiber electroscope to discharge, deflecting the image of the quartz fiber on a readout scale. Proper operation requires that the plastic chamber and electron collection volume be maintained at a vacuum of better than $1\times10^{-4}$ Torr. Gases are given off from the plastic chamber and cause the vacuum to deteriorate with time. To help overcome this "out-gassing" problem, the dosimeter contains a small vacuum ion pump which can be activated by applying an appropriate magnetic field and a suitable high voltage. When good vacuum has been attained, the dosimeter may be returned to service. The complexity of the ion pump technique could be eliminated if an appropriate getter material could be incorporated inside the dosimeter without destroying or degrading performance characteristics of the dosimeter by by heat or vapor deposition.

SUMMARY OF THE INVENTION

Applicant herein has conceived a new and useful method for removing gases produced by the out-gassing of certain materials used in a vacuum vessel containing temperature-sensitive materials. The present invention includes a series of steps or methods, for accomplishing the objectives of the invention as stated herein. A vacuum vessel, such as the dosimeter device as described in the preferred embodiment herein, is placed in a vacuum chamber, along with a getter, and the vacuum chamber is pumped down to the desired vacuum level. The getter is kept from contacting the vacuum vessel while the getter is heated consistent with the temperature and time profile necessary to activate the getter. After activation, the getter is allowed to cool down to a temperature level which would permit it to be placed within the vacuum vessel without damaging temperature-sensitive materials contained therein. The vacuum vessel is remotely sealed by the use of any common convenient sealant material such as cement, solder, epoxy, or even by means of a vacuum cold-seal or welding. Thereafter, the getter absorbs gases which are internally produced as a result of the out-gassing process.

It is therefore an object of this invention to provide an improved method for removing gases produced by out-gassing of materials in a vacuum vessel which contains temperature-sensitive materials.

It is another object of this invention to provide an improved method for placing an activated getter in a vacuum vessel without damaging temperature-sensitive materials which are contained in the vacuum vessel.

It is another object of this invention to provide an improved method for using, in a vacuum vessel, a getter having characteristics which are compatible with the design characteristics of the vacuum vessel and the vacuum chamber in which the getter and the vacuum vessel are integrated.

It is another object of this invention to provide an improved method for using, in a vacuum vessel, a getter which is placed along with said vacuum vessel in a vacuum chamber in positions such that the getter can be heated, consistent with the necessary temperature-time profile, to its activation point, without damaging temperature-sensitive materials which are contained in the vacuum vessel.

A preferred embodiment of this invention demonstrates its application to the use of the getter in a vacuum vessel which, in the drawing herein, is a dosimeter.

For a more complete understanding of the present invention, reference is made to the following description taken in connection with the accompanying drawings in which a preferred embodiment of the invention is illustrated, the scope of the invention being pointed out and contained in the appended claims.

BRIEF DESCRIPTION OF THE DRAWINGS

FIG. 1 is a perspective illustration depicting a schematic relationship of the features of the present invention.

FIG. 2 is a cross-sectional view taken along line 2—2 of FIG. 1, showing the relationship of the getter as it is appended to the sealing plate.

FIG. 3 is a cross-sectional view taken along line 2—2 of FIG. 1, showing, forming a sealing plate, the getter itself as in an optional configuration.

DESCRIPTION OF THE PREFERRED EMBODIMENTS

The drawing of FIG. 1 is illustrative of the present invention wherein the getter is placed within a vacuum which in this preferred embodiment is a quartz-fiber dosimeter.

There is shown, at 10, a vacuum chamber wherein a vacuum vessel 12 has been placed. Attached to the vacuum chamber 10 is an access port 14 through which a manipulation device 16 has been inserted. The access port 14 provides a vacuum seal to the vacuum chamber 10 and the manipulation device 16. A sealing plate 18 is attached to the manipulation device 16. Attached to the sealing plate 18 and located on the front surface 20 of the sealing plate 18 a suitable vacuum getter 22, as shown in FIG. 2.

An alternate embodiment may utilize the getter 22 as a sealing plate itself as shown in FIG. 3.

Referring again to FIG. 1, there is attached to vacuum chamber 10 an access port 24 through which a heating device 26 is mounted. The access port 24 provides a vacuum seal to the vacuum chamber 10 and the heating device 26. Any suitable heating device, which provides direct or indirect heating to the sealing plate 18, may be used. At 26 there is shown in this embodiment a resistance heating device which heats the sealing plate 18 by passing an electronic current through said sealing plate 18 to activate the getter.

It should be pointed out here that when a getter is first exposed to air through handling prior to its use, a thin layer of oxides and nitrides is formed which protect the material from further contamination. In order to activate the getter in a vacuum it is necessary to diffuse the protective layer into the bulk of the getter material by heating the getter for a combination of time and temperature sufficient to remove the surface oxide and nitride layer. Optimum time and temperature profiles depend upon the getter material selected.

A vacuum is produced in the vacuum chamber 10 by a vacuum pump 28 which is connected to the vacuum chamber 10 by a vacuum port 30. When the proper vacuum has been achieved to permit getter activation, the heating device 26 is activated causing the sealing plate 18 and the getter 22 to experience an increase in temperature. After the appropriate temperature has been reached, the temperature is maintained for the period of time necessary to activate the getter 22. The manipulation device 16 is then moved forward toward the vacuum vessel 12 until the front surface 20 of sealing plate 18 contacts the vacuum vessel 12 at the vacuum vessel opening 36, thus providing a vacuum seal for the vacuum vessel 12. Vacuum valve 32 is thereupon closed and vent valve 34 is opened to permit the vacuum chamber 10 to return to atmospheric pressure and to facilitate removal of the sealed vacuum vessel 12.

Having now described the invention in detail in accordance with the requirements of the patent statutes, those skilled in the art will have no difficulty in making changes and modifications in the individual parts or their relative assembly in order to meet specific requirements or conditions. Such changes and modifications may be made without departing from the scope and spirit of the invention, as set forth in the following claims.

I claim:

1. For use with a vacuum vessel having temperature-sensitive materials therein, a method of reducing outgassing in said vessel by installing an activated getter in said vacuum vessel and sealing said vacuum vessel, while maintaining a vacuum therein, said method comprising the steps of:

(a) placing the vacuum vessel in a vacuum chamber;
(b) placing the getter in said vacuum chamber;
(c) providing a vacuum within said vacuum chamber;
(d) applying heat to the getter, said getter being thereby activated;
(e) reducing the temperature of the getter to a level which would not damage the temperature-sensitive materials in said vacuum vessel;
(f) placing the getter into the vacuum vessel; and,
(g) sealing the vacuum vessel.

2. The method of claim 1, above, wherein the heat applied to the getter is applied consistently with a specified temperature and time profile.

3. The method of claim 1, above, further comprising the additional step of removing the sealed vacuum vessel from the vacuum chamber.

4. For use with a vacuum vessel having temperature-sensitive materials therein, a method of reducing outgassing in said vacuum vessel and sealing said vacuum vessel while maintaining a vacuum therein, said method comprising the steps of:

(a) placing the vacuum vessel in a vacuum chamber;
(b) appending the getter to the inner surface of a sealing plate;
(c) placing the sealing plate, with getter appended thereto, in said vacuum chamber;
(d) providing a vacuum within said vacuum chamber;
(e) applying heat to the getter, said getter being thereby activated;
(f) reducing the temperature of the getter to a level which would not damage the temperature-sensitive materials in said vacuum vessel;
(g) placing the sealing plate on said vacuum vessel in a manner such that the getter, which is appended to the inner surface of the sealing plate, will thereupon be located within said vacuum vessel; and,
(h) sealing the vacuum vessel.

5. The method of claim 4, above, wherein the heat applied to the getter is applied consistently with a specified temperature and time profile.

6. The method of claim 4, above, further comprising the additional step of removing the sealed vacuum vessel from the vacuum chamber.

* * * * *